United States Patent [19]

Nerenberg et al.

[11] 4,236,368

[45] Dec. 2, 1980

[54] CARTON CLOSING AND SEALING APPARATUS FOR LINED CARTONS AND METHOD OF CLOSING SAME

[75] Inventors: Robert W. Nerenberg, Middletown; James H. Shiverdecker, Dayton, both of Ohio

[73] Assignee: The Interstate Folding Box Company, Middletown, Ohio

[21] Appl. No.: 338

[22] Filed: Jan. 2, 1979

[51] Int. Cl.[3] ..... B65B 7/08; B65B 7/18; B65B 7/24

[52] U.S. Cl. ..... 53/491; 53/482; 53/378

[58] Field of Search ..... 53/482, 484, 481, 378, 53/383, 379, 387, 491

[56] References Cited

U.S. PATENT DOCUMENTS

| | | | |
|---|---|---|---|
| 2,309,760 | 2/1943 | First | 53/378 X |
| 2,979,995 | 4/1961 | Bergstein et al. | 53/374 X |
| 3,448,559 | 6/1969 | Bjarno | 53/374 X |
| 3,451,194 | 6/1969 | Nerenberg et al. | 53/374 |
| 4,063,403 | 12/1977 | Bergstein et al. | 53/379 |

*Primary Examiner*—Horace M. Culver

[57] ABSTRACT

Apparatus and method for closing and sealing lined taper top cartons wherein the cartons are advanced in a path of travel with their liner mouths open, the end walls of said carton and the opposite ends of the liner being simultaneously deflected inwardly and the front and rear carton walls and the opposite sides of the liner mouth concurrently displaced toward each other to juxtapose the upper edges of the front and rear walls with the liner mouth flattened therebetween, the flattened liner mouth then folded upon itself to form a double thickness mouth, the folded liner mouth and an end closure flap hinged to the carton rear wall then being simultaneously folded over the upper edge of the carton front wall and the folded closure flap secured to the front wall of the carton.

15 Claims, 11 Drawing Figures

CARTON CLOSING AND SEALING APPARATUS FOR LINED CARTONS AND METHOD OF CLOSING SAME

BRIEF SUMMARY OF THE INVENTION

This invention relates to apparatus and method for closing and sealing paperboard cartons and relates more particularly to the closing and sealing of a lined carton having a tapered top closure.

A carton adapted to be closed and sealed in accordance with the invention comprises enclosing side and end walls, and a bottom formed from end closure flaps hingedly connected to the bottom edges of the body walls. The carton body is lined with a tubular liner, preferably presealed at its bottom end, the top or mouth of the liner projecting beyond the uppermost ends of the body walls. The upper portions of the carton end walls are scored to provide bellows-like gussets which, when deflected inwardly, permit the upper portions of the carton side walls to be displaced inwardly, thereby forming a tapered top closure in which the uppermost edges of the side walls are juxtaposed with the uppermost edges of the bellows folded portions of the end walls entrapped therebetween. The inward deflection of the gussets also serves to automatically infold the corresponding portions of the liner mouth, and as the carton side walls are moved toward each other the opposite sides of the liner mouth are concurrently juxtaposed. Heretofore, it has been the practice to heat seal the flattened liner mouth, whereupon a closure flap hingedly connected to the uppermost edge of one of the side walls is folded over the uppermost edge of the opposite side wall and secured in the folded-over position, the folding of the closure flap also serving to fold-over and entrap the sealed end of the liner between the closure flap and the underlying side wall. When it is desired to dispense the contents of the carton, the closure flap is opened and the liner severed beneath the seal. If less than all of the contents is dispensed from the carton, it may be reclosed by repeating the folding procedure, the upper edge of the side wall opposite the closure flap forming a folding edge for the remaining portion of the liner mouth, the folded-over liner mouth being held in the folded-over condition by the closure flap, thereby reclosing the liner. While the reclosure so-formed effectively protects the remaining contents of the carton, there are situations wherein this type of reclosure is ineffective.

A demand has arisen for inexpensive cartons which, in addition to initially packaging a product for sale, may be used by the purchaser to prepare the product for use. For example, dry pancake mix may be packaged in a carton which also serves as a shaker for admixing the contents with water or milk, the user initially opening the carton, adding the desired quantity of liquid, reclosing the carton and shaking it until the ingredients have been thoroughly admixed, whereupon the carton is reopened and the contents poured directly onto the griddle for cooking. A taper top carton lends itself to such use, particularly since the bellows-like gussets, when displaced outwardly, form a pouring spout by means of which the admixed contents may be readily dispensed. However, the reclosed carton must be leakproof since the contents with added liquid must be thoroughly shaken to insure thorough admixing of the ingredients, and it has been found that simply folding the liner mouth over the upper edge of the opposite body wall is unsatisfactory for such purpose.

It has been found that a taper top carton can be made liquid-tight even when subjected to vigorous shaking by increasing the length of the liner mouth and providing a double fold, the liner mouth being folded upon itself, and the double thickness liner mouth then folded over the uppermost side edge of the opposite carton side wall and held in the folded-over condition by the overlying end closure flap. This double folding of the liner mouth and its retention in the double folded condition results in a reliable leakproof reclosure.

The objective of the present invention is the provision of apparatus and procedures by means of which lined cartons of the character described may be readily fabricated in a high speed operation as the cartons are continuously advanced in a path of travel. In particular, the present invention is directed to apparatus and procedures for handling taper top cartons having liners formed from thin, limp films which are difficult to manipulate and require special handling in order to insure neat and accurate folding.

BRIEF DESCRIPTION OF THE DRAWINGS

FIGS. 1A through 1E are perspective views illustrating successive stages in the formation of the closed and sealed end closure.

FIG. 4 illustrates the carton in the fully reclosed condition.

DETAILED DESCRIPTION

Figures 1, 2:
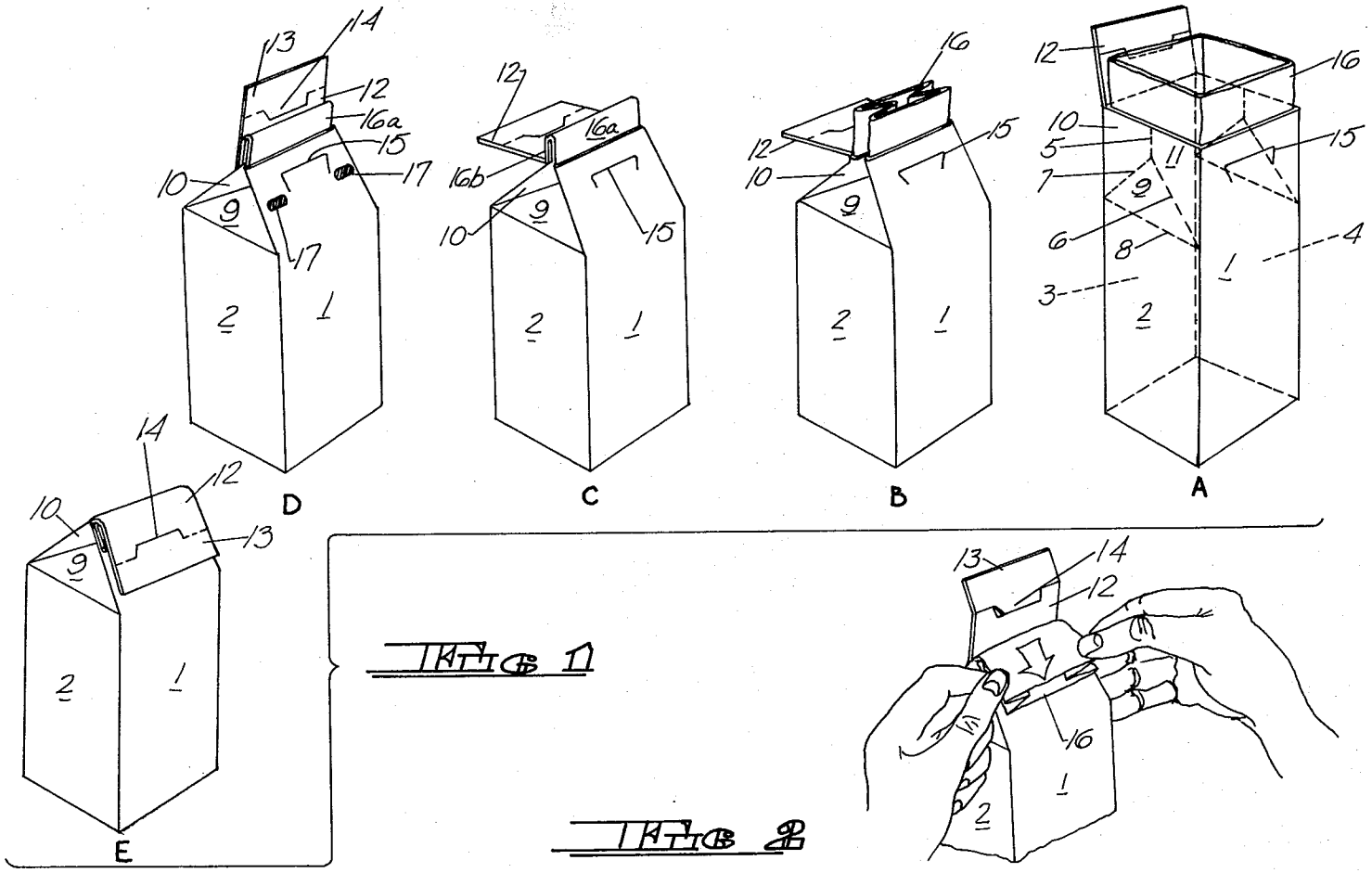
FIG. 2 is a fragmentary perspective view illustrating the manner in which reclosing the carton is initiated.

Referring first to FIGS. 1A through 1E which illustrates successive stages in the initial folding and sealing of the carton, the carton comprises enclosing body walls 1, 2, 3 and 4 hingedly connected in the order named to provide a tubular body. Normally, body wall 1 is the front wall, body wall 3 the rear wall, and body walls 2 and 4 the opposite end walls. End walls 2 and 4 are scored or cut-scored at their upper ends to provide medially disposed vertical lines of fold 5 which terminate in angularly disposed lines of fold 6 and 7 extending diagonally downwardly to the opposite side edges of the end walls, the lowermost extremeties of the diagonal lines of fold being interconnected by horizontally disposed lines of fold 8, the liner of fold collectively defining bellows-like gussets 9, 10 and 11. The length of the gussets may vary relative to the length of the opposing end walls, although preferably they will lie within the upper half of the carton body walls so that a major portion of the carton will be rectangular in cross-section when erected. An end closure flap 12 is hingedly connected to the uppermost edge of rear wall 3, the closure flap, as possibly best seen in FIG. 1D, having a foldable extension 13 with a centrally disposed tongue 14. Body wall 1 is provided with a tongue receiving slot 15. The carton is lined with a tubular liner 16 the mouth of which projects upwardly beyond the body walls.

The carton will be filled with contents when in the condition illustrated in FIG. 1A, whereupon the bellows-like gussets 9, 10 and 11 will be deflected inwardly in the manner illustrated in FIG. 1B, the inward deflection of the gussets causing the front and rear walls 1 and 3 to be displaced inwardly until their upper edges coincide. This movement also causes the opposite ends of the mouth of the liner 16 to be folded inwardly and the opposite sides flattened. After flattening, the liner mouth is folded upon itself, preferably in the direction of end closure flap 12, thereby bringing the liner mouth to the condition shown in FIG. 1C, the folded liner mouth defining an inner portion 16*a* and a reversely folded outer portion 16*b*. When in the folded condition, the double thickness liner mouth will be pressed together so as to crease the liner, whereupon end closure flap 12 will be infolded, the infolding of the end closure flap acting to fold the liner mouth over the uppermost edge of body wall 1 along the base edge of inner portion 16*a*. Spots of adhesive 17 will be applied to the body wall 1 in positions to be contacted by the extension 13 of the closure flap when infolded, thereby adhering the closure flap to body wall 1 with the folded liner mouth sandwiched therebetween, the carton assuming the condition illustrated in FIG. 1E. The length of the liner mouth will be chosen so that when folded to double thickness, its width will be no greater than the width of closure flap 12, the extension 13 thus extending beyond the folded liner mouth for direct contact with the underlying portion of body wall 1.

Figures 3, 4A, 5:
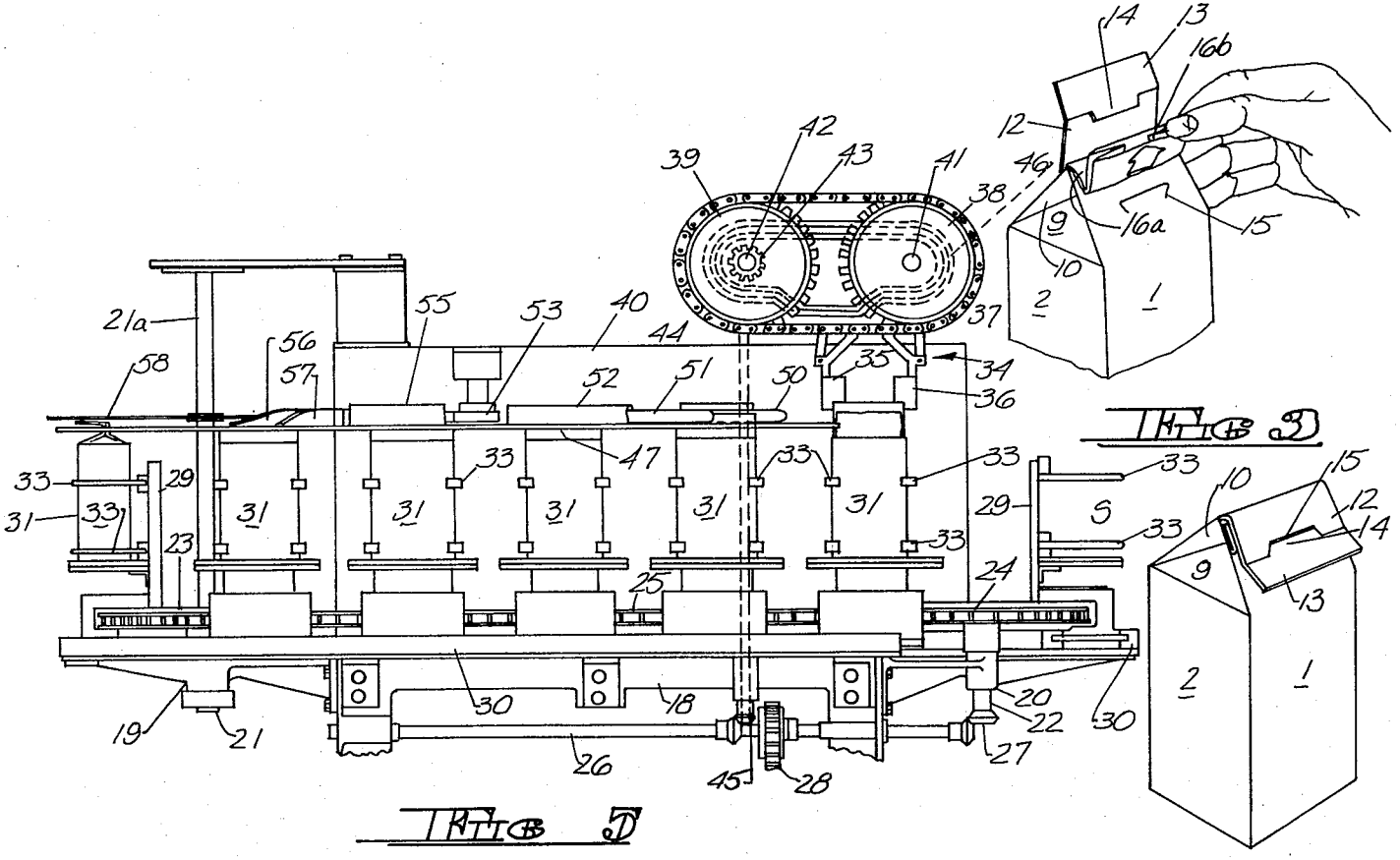
FIG. 3 is a fragmentary perspective view illustrating another step in the reclosing of the end closure.
FIG. 5 is a partial side elevational view of carton closing and sealing apparatus utilized to close and seal the end closures.

In the hands of the user, the carton may be opened by lifting the extension 13 to break the seal between the spots of adhesive 17 and the underlying body wall 1, whereupon the carton may be reopened to the condition illustrated in FIG. 1A. The user may then pour the required quantity of liquid into the carton and the carton reclosed. Reclosure is accomplished by deflecting the bellows-like gussets 9, 10 and 11 inwardly and pressing together the uppermost edges of the front and rear body walls 1 and 3, followed by the downward folding of the liner mouth in the manner illustrated in FIG. 2. The outermost portion 16*b* of the liner mouth is then reversely folded in the manner illustrated in FIG. 3, thereby again forming a folded double thickness liner mouth, whereupon the closure flap 12 is infolded and the tongue 14 engaged in slot 15, as seen in FIG. 4, thereby entrapping the reversely folded, double thickness liner mouth between the closure flap 12 and underlying body wall 1. This orientation of the liner mouth has been found to provide a liquid tight seal even when the carton is repeatedly shaken to admix its contents. It also may be observed that during initial closing of the carton, the liner need not be heat sealed or otherwise adhered together, the folding and reverse folding of the liner being sufficient to effectively protect the contents. Of course, if desired, the mouth of the liner may be initially sealed, preferably along its outermost edge, although care should be taken to be certain the seal may be readily broken or, if it is severed, that sufficient liner material remains to permit the liner mouth to be folded upon itself.

After the contents have been thoroughly shaken, the carton is again reopened and the contents dispensed. To this end, one of the sets of bellows-like gussets may be deflected outwardly, along with the continuous area of the liner, thereby forming a pouring spout by means of which the admixed contents may be dispensed.

Reference is next made to FIG. 5 which illustrates apparatus utilized to form the end closure just described. The basic apparatus is of the type disclosed in U.S. Pat. No. 4,063,403, and comprises a main frame 18 mounting bearings 19 and 20 adjacent its opposite ends in which vertically disposed shafts 21 and 22 are rotatably journaled, the shafts mounting horizontally disposed sprockets 23 and 24 about which an endless conveyor chain 25 moves in a horizontal path of travel. Driving power is supplied to the sprocket 22 through shaft 26 and gears 27, the shaft 26 being connected by a driven sprocket 28 operatively connected to a source of power, which is not shown. The conveyor chain 25 engages a series of spaced apart carriages 29 which are guided about the path of travel of the conveyor chain by channel-shaped guide members 30.

Figure 6:
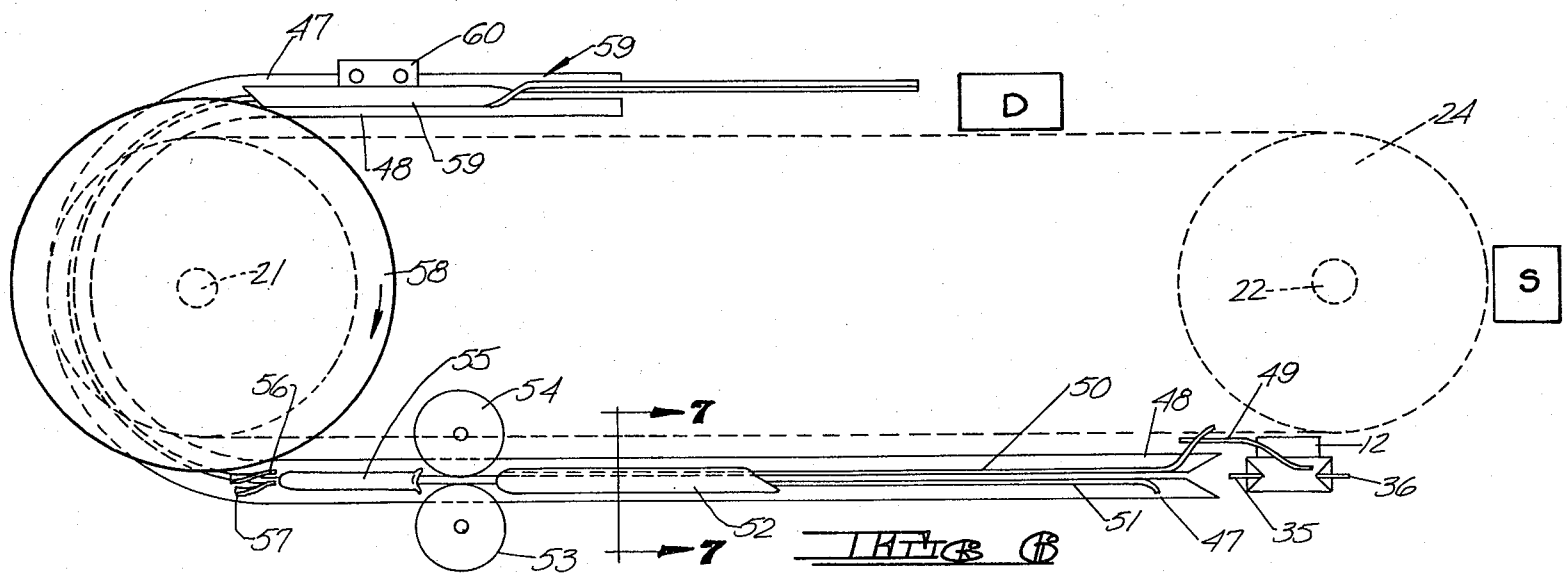
FIG. 6 is a diagrammatic plan view of the apparatus illustrated in FIG. 5 showing the successive operations performed as an incident of closing and sealing the cartons.

Each of the carriages 29 is adapted to receive and convey a carton 31 of the construction previously described the cartons being presented to the carriages at one end of the apparatus at a delivery station S, indicated in FIGS. 5 and 6. Each of the carriages is provided with pairs of locking arms 33 which engage the body walls of the cartons and secure them to the carriages. The cartons will be positioned on the carriages with their front walls facing outwardly, so that the end wall 2 will be the leading body wall in the direction of travel of each carton and the end wall 4 will be the trailing body wall.

As each carton 31 is advanced by its carriage with the carton in the condition illustrated in FIG. 1A, the medially disposed lines of fold 5 at the upper ends of the end walls 2 and 4, together with the adjacent upstanding end portions of the liner mouth, are contacted by a folding device, indicated generally at 34, the folding device having a pair of folding fingers 35 and 36 which act to deflect the end walls inwardly along the lines of fold 5, thereby causing the bellows-like gussets 9, 10 and 11 to be deflected inwardly together with the opposite end edges of the liner mouth, which are also contacted by the folding fingers.

A series of the folding devices 34, only one of which is shown in FIG. 5, is secured to a conveyor chain 37 which passes around sprockets 38 and 39 rotatably journaled on a vertical support 40 projecting upwardly from the main frame 18 by means of shafts 41 and 42, the shaft 42 being driven through gear means 43 connected to a drive shaft 44 having gear means 45 connecting it to previously described drive shaft 26. The folding devices are of the type taught in U.S. Pat. No. 4,063,403, the pairs of folding fingers being arranged to move from opened to closed position and return by linkage members controlled by a continuous cam track 46 adapted to receive cam followers operatively connected to the linkage members. As will be evident from FIG. 5, the folding fingers will lie in the opened position as they approach an underlying carton, whereupon the fingers will be moved to the closed position, such movement causing inward deflection of the bellows-like gussets and the opposite ends of the liner mouth. At the same time the front and rear walls 1 and 3 of the carton will move toward each other, such movement being assisted by means of an opposing pair of guide plates 47 and 48, best seen in FIG. 6, which are positioned to engage the front and rear walls 1 and 3, respectively, adjacent their uppermost edges, thereby insuring that the uppermost edges of these walls will be juxtaposed with the flattened liner mouth projecting upwardly from between the front and rear body walls. As this folding operation takes place, the closure flap 12 will be folded outwardly, as by means of a sweep 49 seen in FIG. 6.

Figure 7:
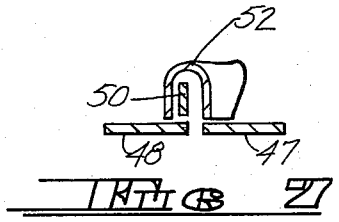
FIG. 7 is a diagrammatic vertical sectional view taken along the line 7—7 of FIG. 6.

A vertically disposed fin 50 overlies guide plate 48 and coacts with a vertically disposed fin 51 overlying guide plate 47, the opposing fins lying in closely spaced apart relation so as to maintain the liner mouth in flattened condition as it advances between the fins. Fin 50 is spaced upwardly from guide plate 48, the guide plate acting to maintain the closure flap 12 in the outfolded condition. Fin 51 terminates immediately adjacent an inverted channel-shaped sweep 52 which engages and folds the liner mouth to the condition illustrated in FIG. 1C. The channel-shaped sweep folds the liner mouth over the uppermost edge of fin 50, the dimensions of the liner mouth being such that it will be doubled upon itself to form the inner portion 16*a* and the reversely folded outer portion 16*b*. The configuration of sweep 52 and its relation to fin 50 and guide plates 47, 48 is shown in FIG. 7.

A pair of pressing wheels 53 and 54 lie immediately beyond the channel-shaped sweep 52, the pressing wheels acting to crease and flatten the folded over liner mouth. Upon passage beyond the pressing wheels, the liner mouth is engaged by an inverted channel-shape member 55 similar to member 52 which serves to maintain the liner mouth in its folded condition preparatory to the infolding of the end closure flap 12, which is retained in its outfolded position overlying guide plate 48 by means of the inverted channel-shaped member 55. A sweep 56 is positioned immediately beyond the trailing end of channel-shaped member 55, the sweep 56 being positioned to engage and infold the end closure flap 12 immediately upon passage of the folded liner mouth beyond the channel-shaped member 55, the infolding of the end closure flap also serving to enforce the infolding of the liner mouth along the base edge of inner portion 16*a*. A second sweep 57 is also located immediately beyond channel-shaped member 55 on its opposite side, the second sweep being positioned to contact and support the liner mouth as its infolding is initiated by the infolding of the end closure flap. The sweeps 56 and 57 coact to bring the closure flap and the liner mouth to an essentially horizontal position with the folded liner mouth resting upon the upper surface of guide plate 47. In this connection, the guide plates 47 and 48 are continuous and extend in a curved path around the end of the machine.

The closure flap and liner mouth are maintained in the partially infolded condition, i.e., in an essentially horizontal position, as they are advanced along the curved end of the guide plate 47, by means of a rotating disc 58 mounted on an upward extension 21*a* of shaft 21, the rotating disc being driven in timed relation to the movement of the carriages 29 and the cartons being conveyed. The rotating disc 58 maintains the end closure flap and liner mouth in the partially infolded condition as the carton travels around the curved end of the machine until the carton reaches the straight line flight on the opposite side of the machine where the partially infolded closure flap is engaged by an overlying sweep 59 as it is released by the disc. An adhesive applicator 60 is mounted adjacent the path of travel of the carton front wall and is positioned to apply the spots of adhesive 17 (seen in FIG. 1D) to the upper portion of the front wall 1, whereupon the sweep curves, as indicated at 59, to complete the infolding of the closure flap, thereby juxtaposing the extension 13 to the spots of adhesive on the upper portion of underlying body wall 1, the sweep continuing for a distance sufficient to insure that the flap extension will be adhered to the underlying carton body wall. The closing and sealing of the carton is now completed and the carton is in the condition illustrated in FIG. 1E. Thereafter the carriages which convey the cartons are opened and the cartons ejected from the machine at a discharge station, diagrammatically indicated at D, where the cartons are discharged from the apparatus. The empty carriages then return to the delivery station S to receive additional cartons to be closed and sealed.

What is claimed is:

1. Apparatus for closing and sealing taper top cartons having front, rear and opposing end walls, a closure flap hingedly connected to the upper edge of the rear wall, the carton including a tubular liner having its open mouth projecting beyond the upper end of the carton body, the upper portions of the end walls being scored to define sets of bellows-like gussets, said apparatus comprising conveying means for advancing the cartons in a path of travel with the opposing carton end walls defining the leading and trailing ends of the cartons, deflecting means for simultaneously deflecting inwardly the opposing sets of bellows-like gussets and the opposite ends of the liner mouth, guide means for concurrently displacing toward each other the upper ends of the front and rear walls so as to juxtapose the uppermost ends of the front and rear walls and flatten the liner mouth therebetween, liner supporting means defining a folding edge for the flattened liner mouth, sweep means positioned to fold the liner mouth over said folding edge to form a reversely folded double thickness liner mouth, pressing means for pressing the folded liner mouth, infolding means for concurrently infolding said closure flap and said reversely folded liner mouth over the upper edge of said front wall, and attachment means for securing the folded closure flap to the front wall of the carton.

2. The apparatus claimed in claim 1 wherein said deflecting means comprises pairs of folding fingers overlying the path of travel of the cartons and traveling therewith in advance of said sweep means, and means for moving said pairs of folding fingers from expanded to closed positions and return.

3. The apparatus claimed in claim 2 wherein said guide means comprises an opposing pair of horizontally disposed guide plates positioned to engage the upper marginal edges of the front and rear walls therebetween.

4. The apparatus claimed in claim 3 wherein said liner supporting means comprises a vertically disposed fin positioned to contact and support one side of the liner mouth, said fin overlying one of said guide plates, with its upper edge positioned to define a folding edge for the liner mouth.

5. The apparatus claimed in claim 4 including a second vertically disposed fin overlying the other of said guide plates, said second fin being positioned to contact and support the opposite side of the liner mouth.

6. The apparatus claimed in claim 5 wherein said sweep means comprises an inverted U-shaped sweep member, and wherein said first named fin lies with said U-shaped sweep member in spaced relation thereto.

7. The apparatus claimed in claim 6 wherein said pressing means comprises an opposing pair of pressing rolls positioned to contact the opposite sides of the folded liner mouth.

8. The apparatus claimed in claim 7 wherein said infolding means comprises sweeps positioned to infold the closure flap and folded liner mouth to an essentially horizontal position in which they overlie and are supported by one of said horizontally disposed guide plates.

9. The apparatus claimed in claim 8 wherein said conveying means moves the carton in an arcuate path upon passage beyond said infolding means, and hold-down means for maintaining the closure flap and liner mouth in horizontal position supported on said last named horizontally disposed guide plate as the cartons move in an arcuate path.

10. The apparatus claimed in claim 9 wherein said hold-down means comprises a rotating disc driven in timed relation to the movement of said conveying means.

11. The apparatus claimed in claim 10 wherein said attachment means comprises an adhesive applicator positioned to interpose adhesive between the end closure flap and the front wall of the carton, and sweep means positioned to juxtapose the closure flap to the front wall of the carton subsequent to the application of the adhesive.

12. A method for closing and sealing taper top cartons each having front, rear and opposing end walls, a closure flap hingedly connected to the upper edge of the rear wall, and a tubular liner within the carton having its open mouth projecting beyond the upper end of the carton body, the upper portions of the carton end walls being scored to define sets of bellows-like gussets, said method comprising the steps of advancing the cartons in a path of travel, simultaneously deflecting inwardly the opposing sets of bellows-like gussets and the opposite ends of the liner mouth and concurrently displacing toward each other the upper ends of the front and rear walls and the opposite sides of the liner mouth so as to juxtapose the uppermost ends of the front and rear walls and flatten the opposite sides of the liner, folding the liner mouth upon itself to form a double thickness liner mouth having an inner portion and a reversely folded outer portion while maintaining the folded liner mouth in essentially vertical position, thereafter simultaneously folding the closure flap and double thickness liner mouth over the upper edge of the front wall, and securing the closure flap to the front wall, whereby the liner mouth is sandwiched between the front wall and the closure flap with the base edge of the inner portion of the liner mouth folded over the upper edge of said front wall and with its reversely folded outer portion extending toward the upper edge of said front wall.

13. The method claimed in claim 12 wherein each carton is advanced in its path of travel with the carton end walls defining the leading and trailing ends of the carton, and wherein the liner mouth is folded upon itself in the direction of the carton rear wall.

14. The method claimed in claim 13 including the step of pressing the double thickness liner mouth immediately following the folding of the liner mouth upon itself.

15. The method claimed in claim 14 including the step of interposing adhesive between the end closure flap and the front wall of the carton as the closure flap and liner mouth are infolded.

* * * * *